US010730075B2

(12) United States Patent
Merzhaeuser et al.

(10) Patent No.: US 10,730,075 B2
(45) Date of Patent: Aug. 4, 2020

(54) DEVICE AND METHOD FOR GENERATING PERCUSSIVE PULSES OR VIBRATIONS FOR A CONSTRUCTION MACHINE

(71) Applicant: EURODRILL GmbH, Drolshagen (DE)

(72) Inventors: Markus Merzhaeuser, Olpe (DE); Tobias Moscaritolo, Meinerzhagen (DE); Henrik Uelhoff, Drolshagen-Herpel (DE)

(73) Assignee: EURODRILL GmbH, Drolshagen (DE)

( * ) Notice: Subject to any disclaimer, the term of this patent is extended or adjusted under 35 U.S.C. 154(b) by 178 days.

(21) Appl. No.: 15/984,043

(22) Filed: May 18, 2018

(65) Prior Publication Data

US 2018/0361432 A1 Dec. 20, 2018

(30) Foreign Application Priority Data

Jun. 19, 2017 (EP) ..... 17176586

(51) Int. Cl.
*E21B 1/04* (2006.01)
*B06B 1/18* (2006.01)
(Continued)

(52) U.S. Cl.
CPC ..... *B06B 1/183* (2013.01); *B06B 1/18* (2013.01); *E02D 7/10* (2013.01); *E02D 7/18* (2013.01);
(Continued)

(58) Field of Classification Search
CPC .... B06B 1/18; E02D 7/10; E02D 7/18; E21B 1/04
(Continued)

(56) References Cited

U.S. PATENT DOCUMENTS 4,026,193 A * 5/1977 Olmsted ..... B06B 1/183 91/216 B
4,031,812 A * 6/1977 Koshelev ..... B06B 1/183 91/224
(Continued)

FOREIGN PATENT DOCUMENTS

DE 30 38 835 A1 4/1981
EP 0 449 286 A1 10/1991
(Continued)

OTHER PUBLICATIONS

An Office Action mailed by the Korean Intellectual Property Office dated May 17, 2019, which corresponds to Korean Patent Application No. 10-2018-0069600 and is related to U.S. Appl. No. 15/984,041.
(Continued)

*Primary Examiner* — Nathaniel C Chukwurah
(74) *Attorney, Agent, or Firm* — Studebaker & Brackett PC

(57) ABSTRACT

A device and a method for generating percussive pulses or vibrations for a construction machine, in which a piston is reversibly reciprocated in a working space in a housing between a first reversal point and a second reversal point, wherein, for the purpose of generating the percussive pulses or vibrations, the piston is set into a reversible movement by a pressure fluid and the pressure fluid is led into and out of the working space in the region of the first reversal point and the second reversal point. The position of the piston is detected by way of a sensor, in that depending on the detected position of the piston a control unit controls at least one controllable valve, through which pressure fluid is led into and/or out of the working space, wherein by the control unit the movement of the piston is controlled.

10 Claims, 1 Drawing Sheet

(51) Int. Cl.
*E02D 7/10* (2006.01)
*E02D 7/18* (2006.01)

(52) U.S. Cl.
CPC ..... *E21B 1/04* (2013.01); *B06B 2201/40* (2013.01); *B06B 2201/73* (2013.01)

(58) Field of Classification Search
USPC ..... 173/1, 2, 4, 176, 206
See application file for complete search history.

(56) References Cited

U.S. PATENT DOCUMENTS

| | | | | |
|---|---|---|---|---|
| 4,646,854 | A * | 3/1987 | Arndt | B25D 9/145 173/207 |
| 6,510,902 | B1 * | 1/2003 | Prokop | E02F 3/966 173/1 |
| 7,404,449 | B2 * | 7/2008 | Bermingham | E02D 13/06 173/128 |
| 8,704,507 | B2 * | 4/2014 | Oksman | B25D 9/00 324/76.11 |
| 2010/0051348 | A1 * | 3/2010 | Andersson | B25D 9/12 175/57 |

FOREIGN PATENT DOCUMENTS

| | | | |
|---|---|---|---|
| EP | 1 728 564 | B1 | 4/2010 |
| EP | 3323564 | A1 | 5/2018 |
| GB | 920158 | A | 3/1963 |
| JP | H04-293400 | A | 10/1992 |
| JP | H07-269503 | A | 10/1995 |
| JP | H08-184042 | A | 7/1996 |
| JP | H11-158860 | A | 6/1999 |
| JP | 2015-137482 | A | 7/2015 |
| WO | 2017/010400 | A1 | 1/2017 |

OTHER PUBLICATIONS

An Office Action mailed by the Canadian Intellectual Property Office dated Jun. 5, 2019, which corresponds to Canadian Patent Application No. 3,005,244 and is related to U.S. Appl. No. 15/984,043.

An Office Action mailed by the Japanese Patent Office dated Jun. 11, 2019, which corresponds to Japanese Patent Application No. 2018-115130 and is related to U.S. Appl. No. 15/984,043.

An Office Action issued by the National Intellectual Property Administration of the People's Republic of China dated Dec. 9, 2019, which corresponds to Chinese Patent Application No. 201810628094.5 and is related to U.S. Appl. No. 15/984,043 with English language translation.

An Office Action issued by the Korean Patent Office dated Nov. 21, 2019, which corresponds to Korean Patent Application 10-2018-0069600 and is related to U.S. Appl. No. 15/984,043 with English language translation.

* cited by examiner

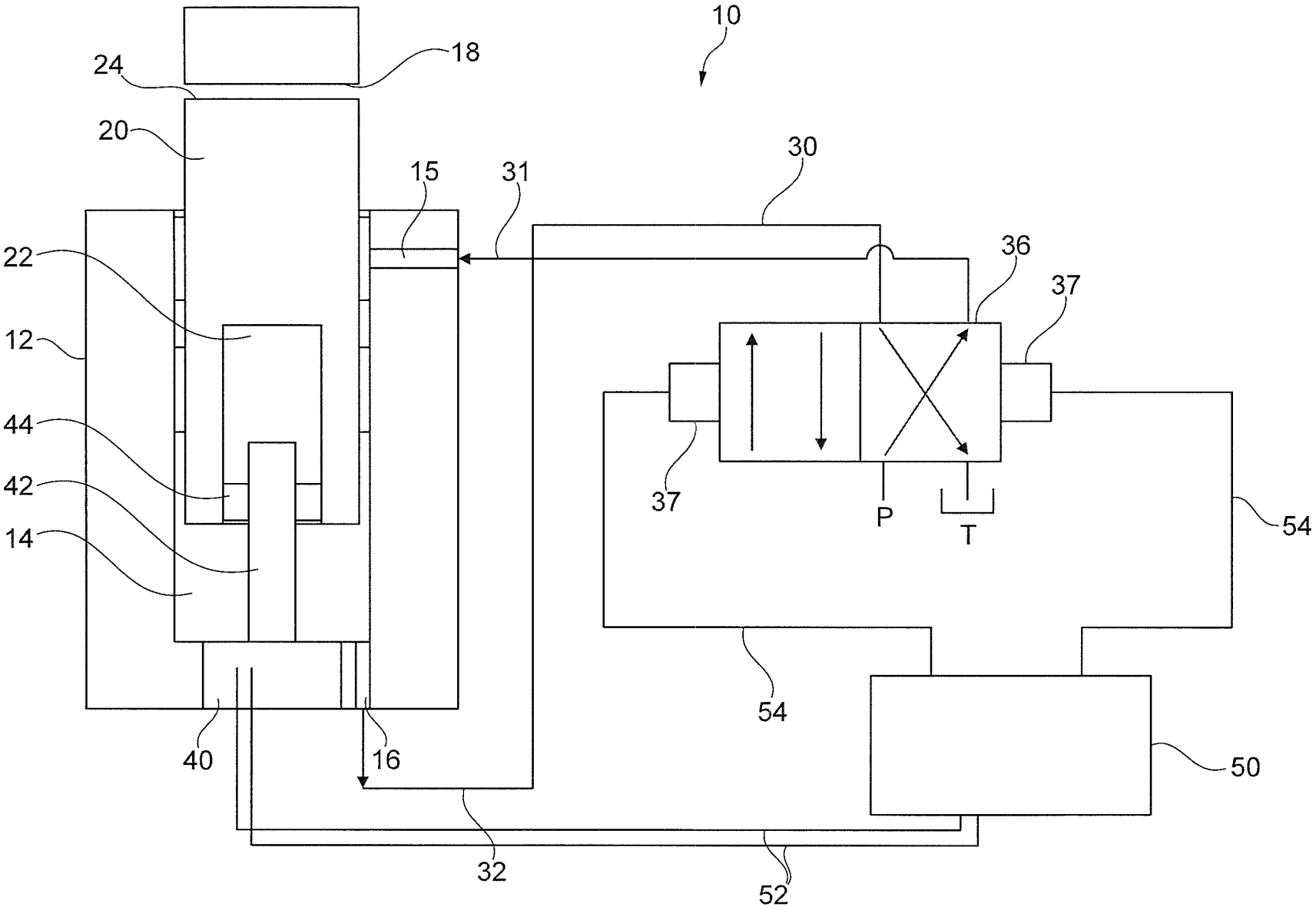
10
18
24
20
22
12
44
42
14
15
16
40
31
32
30
36
37
37
T
P
54
54
50
52

DEVICE AND METHOD FOR GENERATING PERCUSSIVE PULSES OR VIBRATIONS FOR A CONSTRUCTION MACHINE

The invention relates to a device for generating percussive pulses or vibrations for a construction machine, having a housing, a piston which is reversibly reciprocable in a working space in the housing between a first reversal point and a second reversal point, and a pressure fluid supply, through which pressure fluid can in each case be led into and out of the working space in the region of the first reversal point and the second reversal point, wherein the piston can be set into the reversible movement in order to generate the percussive pulses or vibrations.

The invention further relates to a method for generating percussive pulses or vibrations for a construction machine, in which a piston is reversibly reciprocated in a working space in a housing between a first reversal point and a second reversal point, wherein, for the purpose of generating the percussive pulses or vibrations, the piston is set into a reversible movement by means of a pressure fluid and the said pressure fluid is led into and out of the working space in the region of the first reversal point and the second reversal point.

A generic vibration generator is known from EP 1 728 564 B1. In this known vibration generator the working space in the housing is divided by a working piston into two pressure chambers. Via an inlet and an outlet the two pressure chambers are selectively supplied with or discharged from a pressure fluid in an alternating manner so that the working piston moves reversibly and generates a vibration. The timed supply and discharge of pressure fluid into the individual pressure chambers is effected via a complex arrangement of ducts in the working piston. Moreover, inside the working piston a control piston is supported in a displaceable manner which is able to selectively change its position relative to the working piston by means of stops protruding at the front faces of the housing in order to unblock or block certain ducts. Hence, the supply and discharge of pressure fluid is achieved by mechanical measures, wherein a switch-over of the pressure fluid supply and discharge takes place through the given ducts when certain switch-over points are reached.

Comparable mechanical control means in vibration generators can also be taken from GB-A-920,158, U.S. Pat. No. 4,026,193 or U.S. Pat. No. 4,031,812 for example. All these known devices have a working piston and a control piston which, depending on the respective position in the housing, open or close certain ducts, whereby a selective alternating supply of the two opposite pressure chambers is brought about in order to move the working piston.

Devices of such type are time-consuming and costly in production. Moreover, due to the duct layout a certain vibration or percussion behavior of the piston is predefined at a predetermined pressure level. A change of the vibration frequency and the percussion energy are only possible to a very limited extent and in some cases require laborious mechanical reworking.

The invention is based on the object to provide a device and a method for generating percussive pulses or vibrations, with which an increased flexibility with regard to the setting and change of the percussion or vibration behavior can be achieved.

The device according to the invention is characterized in that a measuring means for determining a position of the piston in the working space is provided, that at least one controllable valve is arranged, through which the pressure fluid can be led into and/or out of the working space and in that a control unit is provided which is connected to the measuring means and the at least one controllable valve, wherein by the control unit the movement of the piston in the working space can be controlled and changed.

A basic idea of the invention resides in abandoning a previous elaborate mechanical control of the piston in the working space and in providing for this an electrical or electronic control unit. According to the invention provision is made for at least one measuring means for determining the position of the piston in the working space. The measuring means can emit signals concerning position data of the piston in a continuous manner or in predetermined short time intervals. These signals or data are received by the control unit and processed as a function of a predetermined control logic, whereby control signals or control data are generated for one or several controllable valves. Thus, by way of the at least one controllable valve pressure fluid can be led into and out of the working space in a selective manner.

Consequently, in the case of the device according to the invention there is no need for an elaborately produced working piston with a plurality of lines arranged therein. This reduces the expenditure in manufacturing to a considerable extent. Moreover, the movement behavior of the piston in the housing can now be controlled as well as changed in an especially easy way by changing or adapting the corresponding control logic in the control unit. In this way, the stroke and/or frequency of the reversible movement of the piston can be controlled and changed relatively easily.

For the device according to the invention basically all suitable controllable valves can be employed. According to a further development of the invention it is particularly expedient for the valve to be an electromagnetic valve. The valve body can be adjusted by an electromagnetic arrangement between an open and a closed position. It is also possible to set intermediate positions, thus allowing the quantity of pressure fluid supplied to the working space to be set. Basically, any type of pressure fluid can be provided, in which case use is preferably made of hydraulic oil.

Likewise, concerning the measuring means these can be provided with all usable sensors for length or position measurement that operate, in particular, optically, capacitively, inductively, magnetically or in another way. According to an embodiment of the invention it is especially advantageous for the measuring means to have a linear sensor. This is particularly appropriate if the piston is moved linearly in the housing between the two reversal points.

A preferred embodiment variant of the invention resides in the fact that the measuring means has an elongate first measuring component which extends into the working space and into a free space in the piston. Thus, the measuring component is not arranged behind a wall of the housing but directly in the working space, in which the piston moves. For a particularly precise position measurement the elongate first measuring component protrudes into a corresponding free space in the piston, in which case the piston preferably slides contact-free along the first measuring component.

It is particularly expedient that in the free space of the piston a second measuring component, in particular a magnet, is arranged. The two measuring components interact in such a way that a very precise position determination of the second measuring component and therefore of the piston relative to the first measuring component and thus relative to the working space and the housing can be effected. The first measuring component can have a coil, in which the magnet induces a current of e.g. 4 to 20 mA as a measure for the position of the piston.

Basically, the piston can be moved reversibly in the housing such that the piston does not contact the wall of the housing with its two front faces. In this way, the device can be employed as a so-called vibration generator. An advantageous embodiment of the invention resides in the fact that on at least one reversal point a percussion surface is arranged, onto which the piston strikes specifically in order to generate a percussive pulse. Basically, a percussion surface can be arranged on both opposite front faces of the piston on the housing. By preference, however, only a single percussion surface is present so that specific percussive pulses can be generated as desired for percussion drilling for example.

According to a further variant of the invention it is preferred that by the control unit a frequency and/or a stroke of the piston can be set and adjusted. To change the frequency in particular the opening and closing times and, where appropriate, the supply of hydraulic energy can be set by the control unit. In addition, the stroke of the piston can be reached by changing the position of the two reversal points through a corresponding opening and closing of the controllable valves. For this purpose, the control unit preferably has an input interface, such as an input field. In addition, the control unit can be actuated directly through a customary machine control from an operating unit by an operator.

Another preferred embodiment variant of the invention can be seen in the fact that the control unit has a program memory, in which different control programs for controlling the piston can be stored. For instance specific control programs can be stored for particular application purposes. For example at the beginning of a program a high frequency with a small piston stroke can be provided, whereas in the program sequence the piston stroke then increases and a frequency decreases over time. Provision can be made for almost any number of different program sequences to control the piston with regard to frequency and stroke. For instance a program for quick advancement or a particularly gentle driving process can be provided. In addition, programs for specific types of soil can be stored.

The invention comprises a construction machine which is characterized in that the previously described device for generating percussive pulses or vibrations is arranged. In particular, the construction machine can be provided for foundation engineering.

According to an embodiment of the invention it is especially advantageous for the construction machine to be an earth drilling apparatus. If the device is provided for generating percussive pulses, percussion drilling can be carried out. This is particularly advantageous when penetrating harder layers of rock. Alternatively or additionally, the device can also be designed free from percussion contacts for the generating of vibrations. In an earth drilling apparatus with a drilling tool driven in a rotating manner so-called overburden drilling can thus be carried out in particular. In this, the rotational movement of the drilling tool is superimposed by a vibratory or oscillatory movement. Through superimposed vibrations a liquefaction of the ground, so to speak, can be achieved at least in the contact region with the drilling tool which leads to an improved drilling progress.

Another embodiment of the invention can be seen in the fact that the construction machine is a pile driver or a vibrator. Such pile drivers or vibrators can be used e.g. for the introduction of steel beams, piles or sheet piles which are driven into the ground through percussive pulses or vibrations.

The method according to the invention is characterized in that the position of the piston is detected by way of a measuring means and that depending on the detected position of the piston a control unit controls at least one controllable valve, through which pressure fluid is led into and/or out of the working space, wherein by the control unit the movement of the piston is controlled.

The method according to the invention can be carried out, in particular, with the previously described device. The advantages described beforehand are achieved thereby.

The invention will be described below by reference to a preferred embodiment, which is shown schematically in the attached drawing, in which:

The FIGURE shows a schematic of a preferred embodiment of the present disclosure.

In the single drawing a device 10 according to the invention is illustrated which is designed to generate percussive pulses. The device 10 has a housing 12 with a cylindrical working space 14, in which a piston 20 of approximately cylindrical shape is supported in a linearly movable manner such that it is reversible between two reversal points. The piston 20 is supported in a fluid-tight manner in the housing 12 and, as shown in the embodiment, can protrude with one side from the housing 12. With a free front face 24 the piston 20 strikes onto a corresponding percussion surface 18 which can be an insertion end of a drill drive shaft.

In the region of the upper first reversal point a first opening 15 for a first supply line 31 of a pressure fluid supply 30 is provided on the housing 12. In the region of a lower second reversal point the working space 14 is connected through a second opening 16 to a second supply line 32 of the pressure fluid supply 30. By means of a controllable valve 36, which is designed as a 2/4 directional control valve in the illustrated embodiment, the two openings 15, 16 are alternately connected to a hydraulic pressure source P and an unpressurized disposal tank T. Through this, two opposite pressure chambers in the working space 14 are each alternately filled with pressure fluid and emptied of the pressure fluid. As a result, the piston 20 is set into a desired reversible movement in the housing 12.

According to the invention a measuring means 40 with a first elongate measuring component 42 is provided on the housing 12. The first measuring component 42 is of bar-shaped design and extends into the working space 14 and into a free space 22 arranged correspondingly thereto in the piston 20. In the free space 22 in a lower region thereof a ring-shaped magnet is arranged as second measuring component 44. The second measuring component 44 is firmly connected to the movable piston 20 while the elongate first measuring component 42 is firmly attached to the housing 12. The measuring means 40 is designed e.g. as an inductive linear sensor which precisely ascertains the position of the second measuring component 44 and therefore of the piston 20 with respect to the elongate first measuring component 42 and thus the position of the piston 20 in the working space 14.

Via a line connection 52 the measuring means 40 is connected to a control unit 50, whereby analog signals or digital data on the current position of the piston 20 in the working space 14 are transmitted. Depending on a predetermined program or control logic of the control unit 50 the controllable valve 36 is actuated via electromagnetic elements 37 so that e.g. the first supply line 31 is connected to the unpressurized tank T and the second supply line 32 to the pressure source P, as illustrated in the drawing. When the valve 36 is switched over by the control unit 50 the pressure source P can then be connected to the first supply line 31 while the tank T is connected to the second supply line 32. In this valve position the lower region of the working space 14 is emptied of pressure fluid while an upper region of the working space 14 is at the same time filled with pressure fluid, in which case the piston 20 then moves from the upper first reversal point downwards to the lower second reversal point. When the measuring means 40 establishes that a trigger point of the piston 20 has been reached in the housing 12, a switch-over of the valve 36 can then be effected again by the control unit 50 so that a change of direction is brought about by actuating the electromagnetic elements 37 of the controllable valve 36 via the control lines 54.

Through a corresponding change of the control logic in the control unit 50 the frequency of the piston 20 and the stroke of the piston 20 between the two reversal points can be changed and set without further ado.

The invention claimed is:

1. A device for generating percussive pulses or vibrations for a construction machine, the device comprising:

a housing, a piston which is reversibly reciprocated in a working space in the housing between a first reversal point and a second reversal point, and a pressure fluid supply, through which pressure fluid is able to be led into and out of the working space in a region of the working space on a side of the first reversal point and in a region of the working space on a side of the second reversal point, wherein the piston is able to be set into the reversible movement in order to generate the percussive pulses or vibrations, wherein a sensor having a bar-shaped first measuring component and a ring-shaped magnet as a second measuring component, and configured to determine a position of the piston in the working space is provided, at least one controllable valve is arranged, through which the pressure fluid is able to be led into and/or out of the working space, a control unit is provided which is connected to the sensor and the at least one controllable valve, wherein the control unit is configured to control and change the movement of the piston in the working space, the ring-shaped magnet is fixed at the piston and is arranged in a free space within the piston, at the housing the bar-shaped first measuring component of the sensor is firmly arranged, the first measuring component extending into the working space and into the free space in the piston, and the piston with the ring-shaped magnet slides contact-free along the bar-shaped first measuring component.

2. The device according to claim 1, wherein the valve is an electromagnetic valve.

3. The device according to claim 1, wherein the sensor has a linear sensor.

4. The device according to claim 1, wherein the piston is configured to strike onto a percussion surface which is arranged on at least one reversal point in order to generate a percussive pulse.

5. The device according to claim 1, wherein the control unit is configured to set and adjust a frequency and/or a stroke of the piston.

6. The device according to claim 1, wherein the control unit has a program memory configured to store different control programs for controlling the piston.

7. A construction machine, comprising:

the device for generating percussive pulses or vibrations according to claim 1.

8. The construction machine according to claim 7, wherein the construction machine is an earth drilling apparatus.

9. The construction machine according to claim 7, wherein the construction machine is one of a pile driver and a vibrator.

10. A method for generating percussive pulses or vibrations for a construction machine with the device according to claim 1, in which the piston is reversibly reciprocated in the working space in the housing between the first reversal point and the second reversal point, wherein, for the purpose of generating the percussive pulses or vibrations, the piston is set into the reversible movement by means of the pressure fluid and the said pressure fluid is led into and out of the working space in the region of the working space on the side of the first reversal point and in the region of the working space on the side of the second reversal point, wherein the position of the piston is detected by way of a sensor and depending on the detected position of the piston the control unit controls the at least one controllable valve, through which the pressure fluid is led into and/or out of the working space, wherein by the control unit the movement of the piston is controlled.

* * * * *